United States Patent [19]

Pryor

[11] Patent Number: 4,781,822

[45] Date of Patent: Nov. 1, 1988

[54] SPIRAL SEPARATOR

[75] Inventor: Murray H. Pryor, Roseville, Australia

[73] Assignee: Minpro Pty. Limited, New South Wales, Australia

[21] Appl. No.: 893,649

[22] Filed: Aug. 6, 1986

[30] Foreign Application Priority Data

Aug. 8, 1985 [AU] Australia ..... PH01858

[51] Int. Cl.[4] ..... B03B 5/52

[52] U.S. Cl. ..... 209/459; 209/498

[58] Field of Search ..... 209/459, 460, 497–499, 209/697, 434

[56] References Cited

U.S. PATENT DOCUMENTS

| | | | |
|---|---|---|---|
| 627,970 | 7/1899 | Boguszewski | 209/697 |
| 638,062 | 11/1899 | Pardee | 209/697 |
| 791,425 | 5/1905 | Johnson | 209/498 X |
| 1,515,776 | 11/1924 | Krussow | 209/697 X |
| 4,207,987 | 6/1980 | Beckham | 209/697 X |

FOREIGN PATENT DOCUMENTS

| | | | |
|---|---|---|---|
| 0116100 | 1/1930 | Austria | 209/697 |
| 0160331 | 5/1905 | Fed. Rep. of Germany | 209/697 |
| 0022244 | 5/1912 | Norway | 209/697 |
| 0012324 | 4/1901 | Sweden | 209/697 |

*Primary Examiner*—Robert B. Reeves
*Assistant Examiner*—Edward M. Wacyra
*Attorney, Agent, or Firm*—Holman & Stern

[57] ABSTRACT

A multi-start spiral separator for separating particles in a stream of such particles according to their respective densities and/or sizes comprises a plurality of substantially helical troughs arranged around a common axis which is substantially vertical, each trough including at an upper end an upwardly-facing open fluid-receiving portion and at a lower end an outlet, and a fluid delivery pipe which delivers fluid to the spiral separator so that fluid is distributed to the receiving portions of the helical troughs uniformly.

17 Claims, 2 Drawing Sheets

SPIRAL SEPARATOR

BACKGROUND OF THE INVENTION

1. Field of the Invention

The present invention relates to multi-start spiral separators adapted for separating particles in a stream of such particles according to their respective densities and/or sizes.

2. Description Of The Prior Art

Conventionally a spiral separator consists of a plurality of helical troughs arranged in a column around a supporting central pillar. The troughs are arranged after the fashion of the threads of a multi-start screw. A column may consist of as many as ten separate troughs each trough being fed at its upper end from an individual slurry feed pipe, by means of which a slurry, such as a slurry of fine coal particles, is fed into the trough. Where a small number of troughs is present in the column this arrangement is satisfactory. However, as the number of troughs increases the arrangement of feed pipes becomes increasingly complicated and cumbersome.

BRIEF SUMMARY OF THE INVENTION

The object of the present invention is to provide a slurry feeding arrangement whereby slurry may be fed simultaneously into a plurality of troughs in a relatively simple and convenient manner.

The present invention provides a multi-start spiral separator comprising a plurality of substantially helical troughs arranged about a common substantially vertical axis, each of the troughs including at its upper end an upwardly open fluid receiving portion, the fluid receiving portions of the trough being arranged around said axis, a fluid delivery means adapted to deliver fluid to the spiral separator and having an end portion coaxial with said axis, and a deflector disposed transversely of the axis and arranged to deflect fluid flowing from the fluid delivery means.

In a preferred embodiment of the present invention the fluid receiving portions of the troughs are arranged uniformly around the vertical axis. In a further embodiment the deflector is disposed such that upon contacting the deflector the fluid is distributed uniformly in a radially outward direction.

In another preferred embodiment of the invention the multi-start spiral separator contains more than five helical troughs. In yet another preferred embodiment of the present invention the inner ends of the receiving portions are protected by caps made of abrasion resistant material.

In a further embodiment of the present invention the fluid is delivered to the spiral separator as an upflow, and in a still further embodiment the fluid is delivered to the spiral separator as a downflow.

In another preferred embodiment of the invention the deflector is removable so as to facilitate cleaning of the fluid delivery means.

BRIEF DESCRIPTION OF THE DRAWINGS

In order that the nature of the invention may be better understood a preferred form thereof is hereinafter described by way of example, with reference to the accompanying drawings wherein.

DETAILED DESCRIPTION

Figure 1:
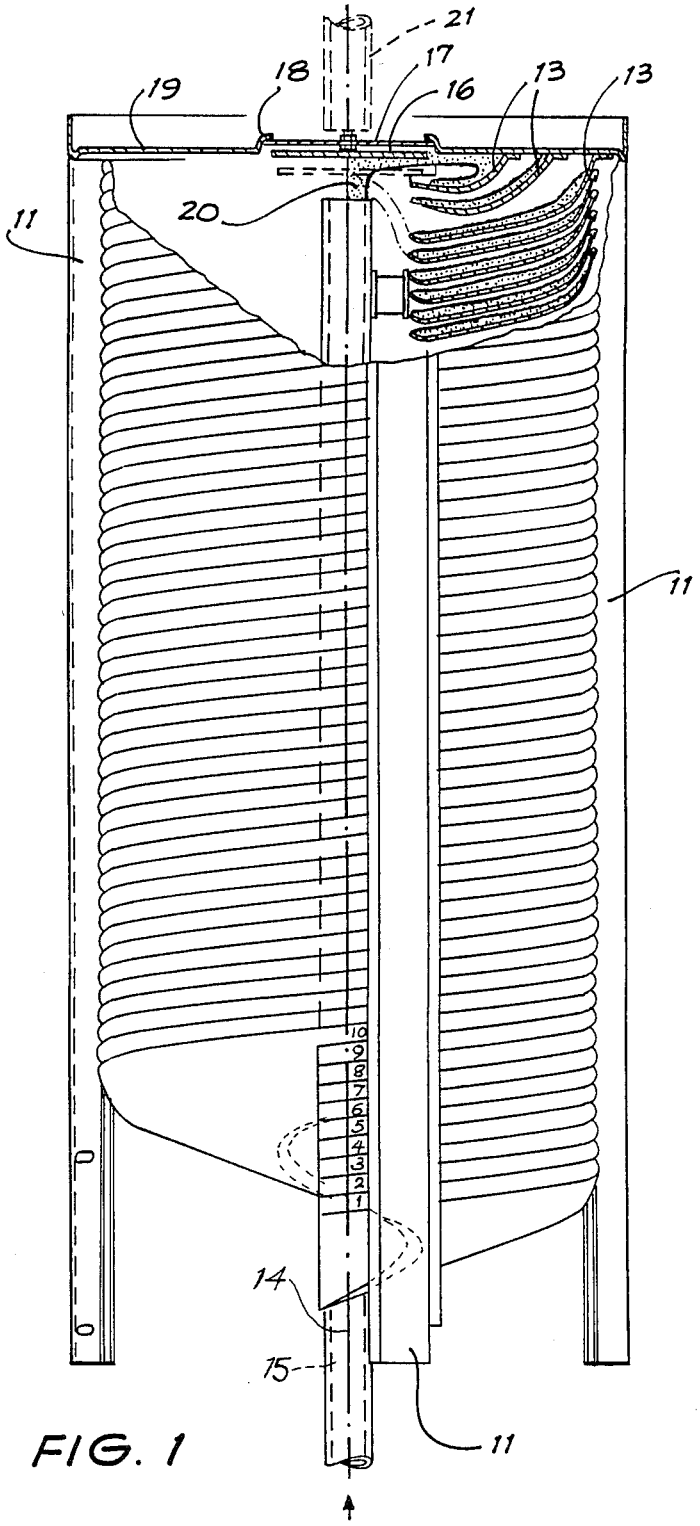
FIG. 1 is an elevational view partially cut-away and partly in cross-section showing a multi-start spiral separator according to the invention.

The multi-start spiral separator of this invention consists of a column of ten helical troughs the outlets of which are numbered 1 to 10 in FIG. 1. The column of troughs is supported on a plurality of legs 11 arranged around the periphery of the column (the legs 11 are shown in FIG. 1 only).

Figure 2:
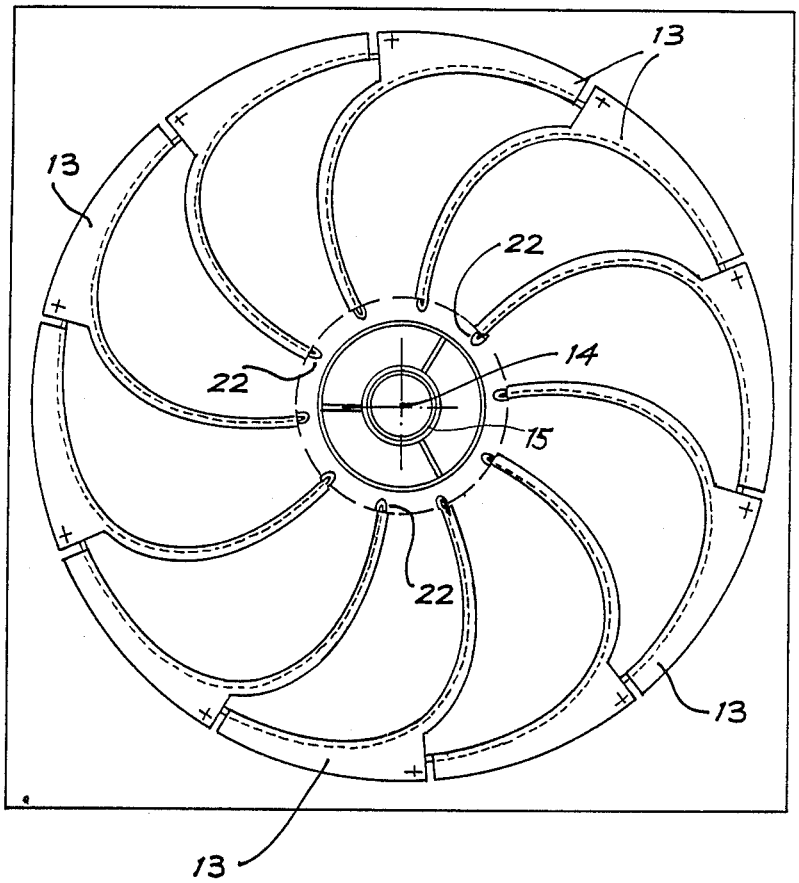
FIG. 2 is a top plan view thereof with the cover plate removed.

Each trough terminates at its upper end in a fluid receiving portion 13 of which ten are seen in FIG. 2 arranged uniformly, after the manner of the sectors of a circle, centered on the axis 14 of the column. Each receiving portion is shaped to meet its respective trough in a smooth curve, each receiving portion 13 projecting downwardly at an angle beneath the next adjacent portion moving around the circle in a clockwise direction. The cut-away sectioned portion of the upper part of FIG. 1 shows the relationship between the upper portions of some of the troughs at one side of the axis 14, the section including three of the receiving portions 13. A slurry 20 is fed upwardly through central pipe 15 to meet the plate 16 which is held in position by means of a bar 17, the ends of which are engaged beneath the flange 18 of a cover plate 19 extending over the top of the separator. The plate 16 extends over the upper outlet end of pipe 15 and bar 17 has a certain degree of flexibility which acts to absorb the force of slurry 20 emitted through the outlet end of pipe 15.

On reaching the plate 16 the slurry is distributed uniformly in a radially outward direction to flow into all the fluid receiving portions 13 simultaneously and thus into the troughs with which they are associated. In an alternative form of construction slurry 20 could be fed in a downward direction through the pipe 21 indicated in broken lines in FIG. 1.

As the slurry leaving the pipe 15 is of an abrasive nature and as the receiving portions 13 and their associated troughs are normally made from a material such as fiberglass the inner ends of the receiving portions 13 are protected by caps 22 made of steel or other abrasion resisting material.

The troughs 1 to 10 discharge at their lower end in a conventional manner into a splitter box (not shown) and the separator functions otherwise in a conventional manner.

The invention provides a simple and straight forward construction whereby a slurry is fed simultaneously and uniformly into all ten troughs avoiding the necessity for providing a complicated arrangement of piping to feed each trough individually.

I claim:

1. A multi-start spiral separator for fluid materials comprising:

a plurality of stationary substantially helical troughs arrayed around a common substantially vertical axis and having upper and lower ends;

an upwardly facing open fluid material-receiving portion at the upper end of each trough, said receiving portions being arranged around said axis;

a substantially planar deflector disposed substantially normal to said axis and adapted to deflect fluid material fed onto the surface thereof substantially uniformally into said fluid material-receiving portions; and a fluid material delivery means having an elongate delivery end portion coaxial with said axis for feeding fluid material onto the surface of said planar deflector.

2. A multi-start spiral separator as claimed in claim 1 wherein:

said receiving portions of said troughs are arranged uniformly around said axis.

3. A multi-start spiral separator as claimed in claim 2 wherein:

said deflector is disposed such that upon contacting the deflector the fluid material is distributed uniformly in a radially outward direction.

4. A multi-start spiral separator as claimed in claim 3 wherein:

there are more than five helical troughs.

5. A multi-start spiral separator as claimed in claim 3 wherein:

said receiving portions have radially inner ends protected by caps made of abrasion resistant material on said radially inner ends.

6. A multi-start spiral separator as claimed in claim 3 wherein:

the fluid material is delivered onto said deflector surface as an upflow through said elongate delivery end portion.

7. A multi-start spiral separator as claimed in claim 3 wherein:

the fluid material is delivered onto said deflector surface as a downflow through said elongate delivery end portion.

8. A multi-start spiral separator as claimed in claim 3 wherein:

said deflector is removable.

9. A multi-start spiral separator for fluid materials as claimed in claim 3 and further comprising:

means to resiliently support said planar deflector above said receiving portins for limited movement substantially in the direction of said axis in response to the force of the fluid material on said surface of said deflector.

10. A multi-start spiral separator for fluid materials as claimed in claim 9 wherein said means to support said planar deflector comprises:

a cover plate extending over and above said receiving portions;

flexible bar means mounted at the central portion of said cover plate; and means for connecting said planar deflector to said flexible bar means.

11. A multi-start spiral separator for fluid materials as claimed in claim 10 wherein:

said planar deflector has a circular shape with a central axis coaxial with said vertical axis and an outer radius greater than the radius of the inner ends of said receiving portions with respect to said vertical axis.

12. A multi-start spiral separator for fluid materials as claimed in claim 9 wherein:

said planar deflector has a circular shape with a central axis coaxial with said vertical axis and an outer radius greater than the radius of the inner ends of said receiving portions with respect to said vertical axis.

13. A multi-start spiral separator for fluid materials as claimed in claim 12 wherein said fluid material delivery means comprises:

a pipe having a central axis extending substantially coaxially with said vertical axis through the central region of said troughs, and an open upper outlet end terminating in spaced relationship below said planar deflector.

14. A multi-start spiral separator for fluid materials as claimed in claim 13 wherein:

said helical troughs have inner peripheries in radical spaced relationship to said pipe forming an axially extending open central region; and said fluid material delivery means extend through said open central region.

15. A multi-start spiral separator for fluid materials as claimed in claim 3 wherein:

said planar deflector has a circular shape with a central axis coaxial with said vertical axis and an outer radius greater than the radius of the inner ends of said receiving portions with respect to said vertical axis.

16. A multi-start spiral separator for fluid materials as claimed in claim 1 wherein said fluid material delivery means comprises:

a pipe having a central axis extending substantially coaxially with said vertical axis through the central region of said troughs, and an open upper outlet end terminating in spaced relationship below said planar deflector.

17. A multi-start spiral separator for fluid materials as claimed in claim 16 wherein:

said helical troughs have inner peripheries in radial spaced relationship to said pipe forming an axially extending open central region; and said fluid material delivery means extends through said open central region.

* * * * *